United States Patent [19]

Ehmke

[11] Patent Number: 4,624,430

[45] Date of Patent: Nov. 25, 1986

[54] LADDER CADDY

[76] Inventor: Richard D. Ehmke, 5104 Van Buren Rd., Dunkirk, N.Y. 14048

[21] Appl. No.: 742,696

[22] Filed: Jun. 7, 1985

[51] Int. Cl.[4] ..... E06C 7/14

[52] U.S. Cl. ..... 248/211; 248/312.1

[58] Field of Search ..... 248/211, 210, 238, 312.2, 248/235; 182/116, 121, 120, 122

[56] References Cited

U.S. PATENT DOCUMENTS

| | | | |
|---|---|---|---|
| 2,622,833 | 12/1952 | Robinson | 248/211 |
| 2,895,700 | 7/1959 | Johnson | 248/210 |
| 3,229,943 | 1/1966 | Olson | 248/210 |
| 3,495,683 | 2/1970 | Broden | 182/116 |
| 4,534,528 | 8/1985 | Rousseau | 248/210 |

*Primary Examiner*—J. Franklin Foss

*Attorney, Agent, or Firm*—Harvey B. Jacobson

[57] ABSTRACT

A ladder caddy for supporting work tools, paint cans and the like on a stepladder comprises a channel-shaped rail for fitting over one of the ladder uprights, a hook member on a crossbar at the top of the rail for engaging over a rung of the ladder with a lower edge portion of the rail engaging on the top of the rung below, and a support tray on the outside of the rail. The hook member and tray can be assembled selectively on each side of the rail so that the caddy can be used on either one of the ladder uprights.

6 Claims, 4 Drawing Figures

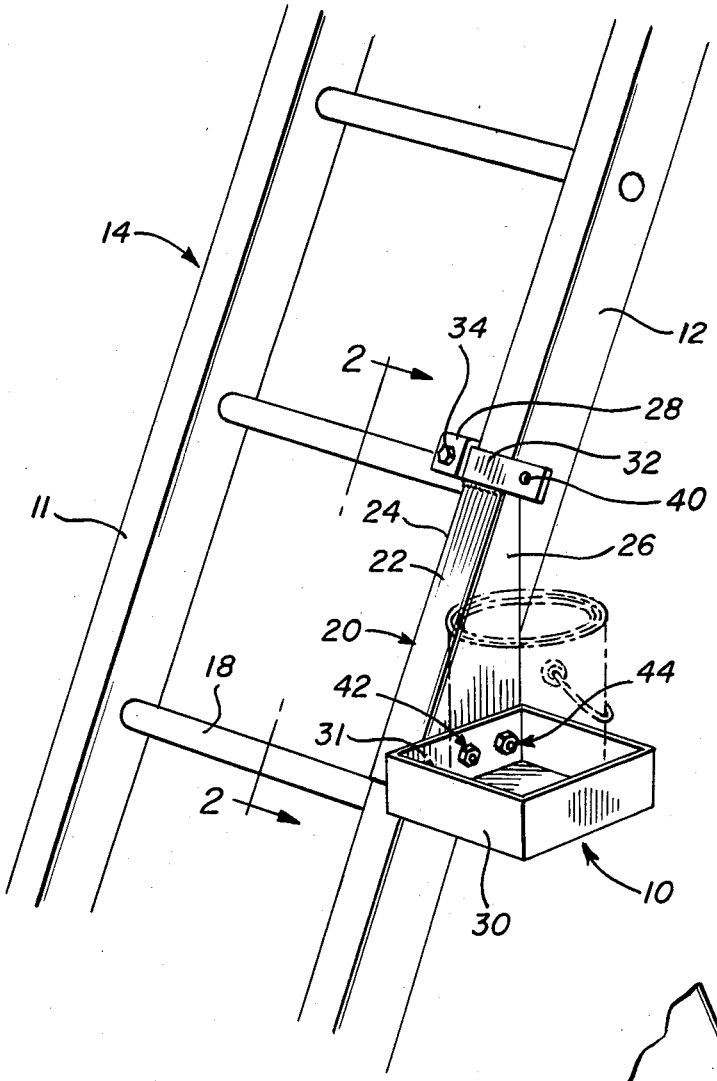
FIG. 1
FIG. 3
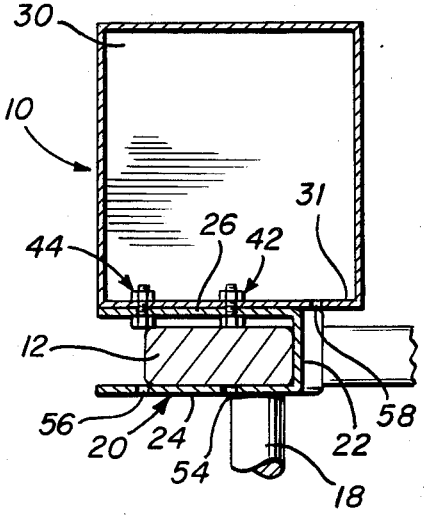
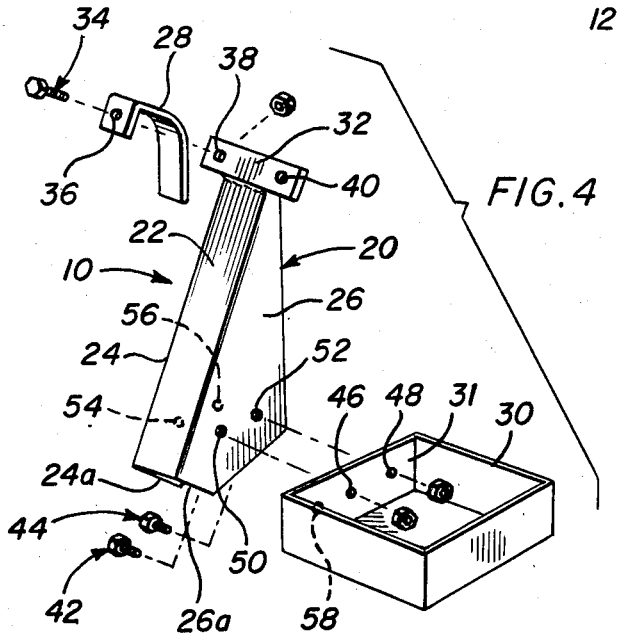
FIG. 4
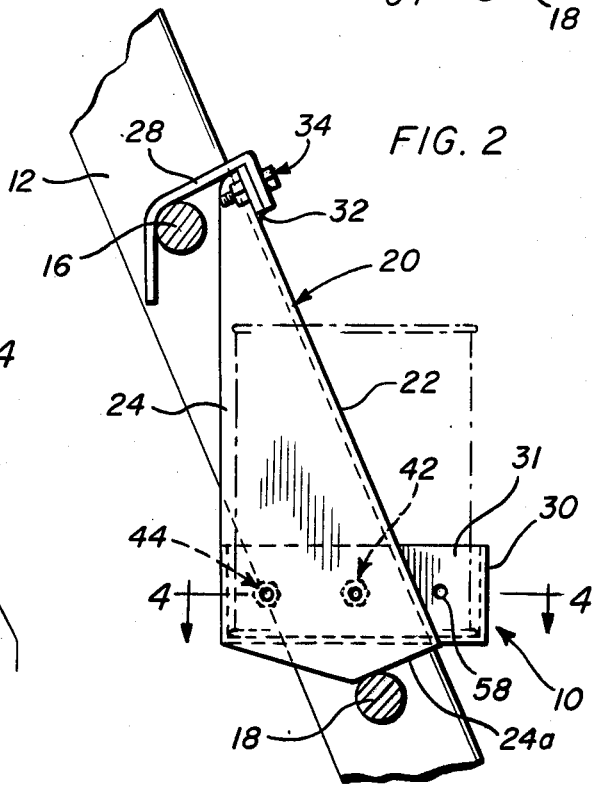
FIG. 2

LADDER CADDY

BACKGROUND OF THE INVENTION

This invention relates to a caddy device for releasable attachment to a stepladder to provide a stable support, such as a tray or shelf, on the ladder for holding articles such as paint cans and brushes, work tools, or the like, in a manner whereby such articles are readily accessible to a person on the ladder.

STATEMENT OF PRIOR ART

Applicant is aware of the following U.S. patents, the relevance of which is that they relate to support-type ladder attachments and the like. None of the patents, however, discloses a device having the features of the present invention.

U.S. Pat. No. 1,488,530
U.S. Pat. No. 1,880,319
U.S. Pat. No. 2,226,228
U.S. Pat. No. 2,308,805
U.S. Pat. No. 2,759,620
U.S. Pat. No. 2,837,306
U.S. Pat. No. 3,052,442
U.S. Pat. No. 3,229,943

SUMMARY OF THE INVENTION

The invention provides a caddy attachment for a stepladder which is of simple yet durable construction, which is releasably attached to a ladder in a manner providing an extremely stable and secure support of the device while inhibiting accidental dislodgement thereof, and which can be readily adapted for attachment on opposite sides of the ladder so that it is equally conveniently accessible to left and right handed persons.

A ladder caddy in accordance with one aspect of the invention comprises a channel-section rail adapted to fit over a ladder upright, a hook at an upper end of the rail on one side thereof for hooking over one rung of the ladder, a support member such as a tray on the other side of the rail, the rail being of a height such that with the hook member engaged over the one ladder rung as aforesaid, a lower edge portion of one web of the rail engages the top of the rung below. With this arrangement, the engagement of the rail on the top of the rung below provides a firm support for the device and the hook engaging over the rung above provides security against outward tilting of the caddy inhibiting its accidental dislodgement, this effect being enhanced when the support member is loaded.

In another aspect of the invention, in a ladder caddy having a channel-section rail, a hook, and a support member of the general kind referred to above, the hook and support member can each be releasably secured to the rail on its opposite sides so that the device can be assembled either to fit on the left hand upright of a ladder or on the right hand upright.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is a perspective view of a ladder caddy in accordance with the invention shown in operative position on a stepladder.

FIG. 2 is an enlarged sectional view on line 2—2 of FIG. 1.

FIG. 3 is a sectional view on line 4—4 of FIG. 2.

FIG. 4 is an exploded perspective view of the ladder caddy.

DESCRIPTION OF PREFERRED EMBODIMENT

A ladder caddy 10 in accordance with the invention is shown in FIGS. 1 to 3 of the drawings attached on the right hand upright 12 of a stepladder 14 between an upper ladder rung 16 and a lower rung 18.

Caddy 10 comprises a channel-section rail 20 conveniently of metal, having a flange 22 and webs 24, 26, a hook member 28, and a support tray 30. The upper end of flange 22 of the rail has a welded-on T-bar 32, and the hook member is releasably attached to the T-bar at one side of the rail by a bolt and nut connector 34 fitting through holes 36, 38 in the hook and the T-bar respectively. The opposite end of the T-bar has another hole 40 enabling the hook to be attached on the other side of the rail when the caddy is to be fitted on the left hand upright 11 of the ladder. Tray 30 is releasably attached to web 26 of the rail by bolt and nut connectors 42, 44 fitting through holes 46, 48 in a side wall 31 of the tray and corresponding holes 50, 52 in web 26. Web 24 has like holes 54, 56 and tray 30 has a further hole 58 whereby the tray can alternatively be attached to web 24 when the caddy is fitted on upright 11.

The width of rail 20 is adapted to the width of the ladder uprights so as to fit snugly thereon, while the height and configuration of the rail is such that when hook member 28 is engaged over an upper ladder rung, such as rung 16, a lower edge portion **24*a* of web 24 will engage the top of a lower rung, such as rung 18 when the rail is fitted on upright 12 as shown in the drawings and similarly, when the tray and hook member are reversed, and rail 20 is fitted on upright 11, a lower edge portion 26*a* of web 26 will engage the top of the lower rung. The fitting of rail 20 over the ladder upright and the engagement of the lower edge portion of the rail against the top of the lower rung provides a firm support for tray 30, and hook member 28** engaged over the upper rung serves to inhibit accidental dislodging of the caddy. Further, the stability of the device is enhanced under the weight of a load on the tray. Removal of the caddy is also readily accomplished by a simple lifting motion, and conversion of the device between the right and left handed configurations is easily accomplished by transfer of the three bolt-and-nut connectors.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A caddy attachment for a stepladder comprising a channel section rail adapted to fit over an upright of the ladder, the rail having inner and outer webs connected by a flange, a support member on the outer web of the rail, and the inner web of the rail having a lower edge portion for engaging the top of a first ladder rung to support the attachment, wherein the rail has a hook member at its upper end inside of said inner web for engagement over a second rung of the ladder above the first rung, wherein the hook member is secured to a projecting bar mounted on the flange of the rail, wherein the bar projects on both sides of the rail, the hook member being releasably attachable to the bar selectively at the respective ends thereof, and the support member being releasably attachable to each of the webs of the rail whereby the attachment can be selectively assembled for use on each of the uprights of the ladder.

2. The invention of claim 1 wherein the support member is a tray.

3. A caddy attachment for a stepladder comprising a channel-section rail for fitting over an upright of the ladder, the rail having side webs and a flange connecting the webs, a hook member, a first releasable attachment means for releasably securing the hook member at an upper end of the rail selectively on opposite sides thereof so that the hook member can be engaged over a ladder rung when the rail is fitted over one or other of the ladder uprights, a support shelf member, and second releasable attachment means for releasably securing the support shelf member selectively on a respective web of the rail on a side opposite the hook member so that the support shelf member is located on the outside of the respective ladder upright when the rail is engaged as aforesaid, wherein the rail has a crossbar at its upper end with opposite ends of the cross bar projecting on opposite sides of the rail, and wherein the first releasable attachment means is adapted to secure the hook member selectively to said opposite ends of the crossbar.

4. The invention of claim 3 wherein the length of the rail is selected such that with the hook member engaging over a ladder rung as aforesaid, a bottom edge portion of the rail engages on the rung below.

5. The invention of claim 3 wherein the first and second releasable attachment means comprise respective bolt-and-nut connectors.

6. The invention of claim 5 wherein the support member is a tray and the second attachment means includes aligned holes in the respective channel webs and a side wall of the tray for receiving the bolt-and-nut connectors.

* * * * *